US005839580A

United States Patent [19]

Budert

[11] Patent Number: 5,839,580

[45] Date of Patent: Nov. 24, 1998

[54] TOOL HOLDER FOR ELONGATE TOOLS

[75] Inventor: Guenter H. Budert, Bachhagel, Germany

[73] Assignee: Knoblauch, Georg, Giengen, Germany

[21] Appl. No.: 890,241

[22] Filed: Jul. 10, 1997

[30] Foreign Application Priority Data

Aug. 29, 1996 [DE] Germany ..... 296 14 905 U

[51] Int. Cl.[6] ..... B65D 85/20

[52] U.S. Cl. ..... 206/379; 206/443

[58] Field of Search ..... 206/372, 373, 206/376, 377, 379, 443, 1.5

[56] References Cited

U.S. PATENT DOCUMENTS 3,154,192 10/1964 Cowley ..... 206/379
4,260,057 4/1981 Wall-Andersen ..... 206/379
5,248,030 9/1993 Tarozzi ..... 206/379

*Primary Examiner*—Jacob K. Ackun
*Attorney, Agent, or Firm*—Welsh & Katz, Ltd.

[57] ABSTRACT

The invention relates to a tool holder for elongate tools, in particular for drill bits, with two holder parts which are connected to one another in an articulated manner on one long side. The holder parts can be swung open or closed like a book. Each holder part has a rear wall, four side walls and an open front side. Receiving shafts for the tool which is to be received are provided in each holder part. The receiving shafts are formed by mutually parallel crosspieces which project forwards from the rear wall of the holder part. A flap extends transversely over the receiving shafts of the holder parts. This flap covers part of the open front side and part of each of the crosspieces 5. The flap, in its bottom region, is fixedly or releasably arranged with the holder part such that it can pivot. The flap, in its top region, is connected to the crosspieces 5 and/or the side walls of the holder part by a clamping or latching connection.

7 Claims, 1 Drawing Sheet

TOOL HOLDER FOR ELONGATE TOOLS

The invention relates to a tool holder for elongate tools, in particular drill bits, with two holder parts which are connected to one another in an articulated manner on one long side and can be swung open or closed like a book.

Essentially two types of drill-bit holders have been known up until now. These are intended for hobbies, on the one hand, and for tradesmen or craftsmen, on the other hand. The tool holders conventional for hobbies usually have individual shafts or channels into which the drill bits can be inserted.

The holders are provided with a transparent cover, which is usually configured as a sliding cover. For storage purposes, these tool holders are provided with the typical SB hanging slot.

Hitherto known tool holders for specialist retail outlets and tradesmen or craftsmen—it being the U.S. market which is being considered here, in particular—may comprise two holder parts which are the same size, are connected to one another in an articulated manner on one long side and can be swung open or closed like a book. The drill bits are fastened individually in the two holder parts in each case with the aid of a clamping device. Each drill bit thus has to be latched separately into the holder part. Two clamps are usually even necessary for fastening a drill bit. This fastening device has proved laborious in practice, in particular since, on account of the clamps located closely together, a certain amount of dexterity is necessary for fastening. A further disadvantage is that the individual clamps require a large amount of space. Moreover, the clamps can only be produced with a certain tolerance. This tolerance may result in the clamping, for example, being too weak and in the drill bits being able to drop out easily. Conversely, a very large amount of pressure may be necessary to fix the drill bits in the corresponding clamp.

Despite these disadvantages, this drill-bit holder with two holder parts is very common in specialist retail outlets in some countries, in particular on the U.S. market. The decisive factor here has been that, with the aid of the two holder parts, an optimum display and overview of the drill bits provided in the drill-bit holder is possible. Moreover, the drill holder can be opened more easily. In comparison with a holder provided with a transparent cover, a large number of drill bits can be accommodated in this tool holder.

The drill-bit holders which can be found in specialist retail outlets serving the U.S. market have a separate dimension part with dimensional holes which is attached to the holder. These dimensional holes are to make it easier for the appropriate drill bits to be arranged in place, or, after they have been used, re-arranged, in optimum fashion in the clamps provided.

The object of the present invention is thus to provide a tool holder of the type mentioned in the introduction, in which it is possible for a large number of drill bits to be accommodated clearly, with easy access, in the smallest possible amount of space.

This object is achieved according to the invention by the features of the defining part of the main claim.

The receiving shafts, which are located in each of the two holder parts, make it possible for the drill bits to be introduced into the tool holder without difficulty. The flap, which extends transversely over the receiving shafts and is located in each of the two holder parts, fixes the drill bits in position such that they cannot drop out. Nevertheless, the flap only covers part of the open front side of the corresponding holder part, and thus only part of each of the receiving shafts. This means that it is possible for relatively small drill bits to be pushed into the tool holder without the flap having to be opened. In order that it is also possible for larger drill bits to be fixed and/or introduced easily, the flap, if appropriate, has to be bent open some way. If it is necessary, the flap may also be opened to the full extent since, in its bottom region, it is connected to the holder part such that it can pivot. The top region of the flap is connected to the crosspieces and/or the side walls of the holder part with the aid of a clamping or latching connection. This connection of the flap to the crosspieces and/or the side walls fixes in the receiving shafts of the tool holder those drill bits which have been introduced. Doing without the clamps, which, in the prior art, required a large amount of space, provides additional space for the storage of further drill bits in the drill holder. Of course, it is also possible for the number of drill bits to remain the same and for the dimensions of the tool holder thus to be reduced. The drill-bit receiving shafts, which are formed by the crosspieces, may be produced with a certain tolerance, so that they are compatible for mm measurements and inch measurements.

The invention may further provide for the flap to be provided with slits which latch in the crosspieces. It is advantageous here if the flap, on its top side, has comb-like incisions which can be clamped in protrusions projecting from the crosspieces.

If the flap, in its bottom region, is releasably connected to the holder part, said flap may also be completely removed.

The comb-like incisions on the top side of the flap ensure simple handling, convenient filling and quick emptying of the tool holder. When the two drill-bit-holder halves are swung closed, the resulting pressure automatically causes the projecting protrusions to clamp or latch into the comb-like incisions.

In one configuration of the invention, it may, furthermore, be provided for the flap to be provided with dimensional holes of different diameters, it being advantageous here if there is provided for each receiving shaft a dimensional hole which is adapted to the diameter of the tool which is to be positioned in said shaft.

Since each receiving shaft is provided with a dimensional bore which is adapted to the diameter of the tool which is to be positioned in said shaft, it is possible, in a simple manner, for each tool to be arranged in place directly. It is thus not necessary for one to look for an indication of size on the appropriate drill bit or receiving shaft. The dimensional hole helps to ensure that all of the tools are arranged in the correct places. A separate dimension part on the side, as has been necessary hitherto, is thus dispensed with. If the flap, in its bottom region, is releasably connected to the holder part said flap may also be completely removed from the tool holder. As a result, the flap with its dimensional holes can be used as a separate measuring part.

Advantageous developments and configurations of the invention are described in the rest of the subclaims.

An exemplary embodiment of the invention is described with reference to the drawing, in which.

Figure 1:
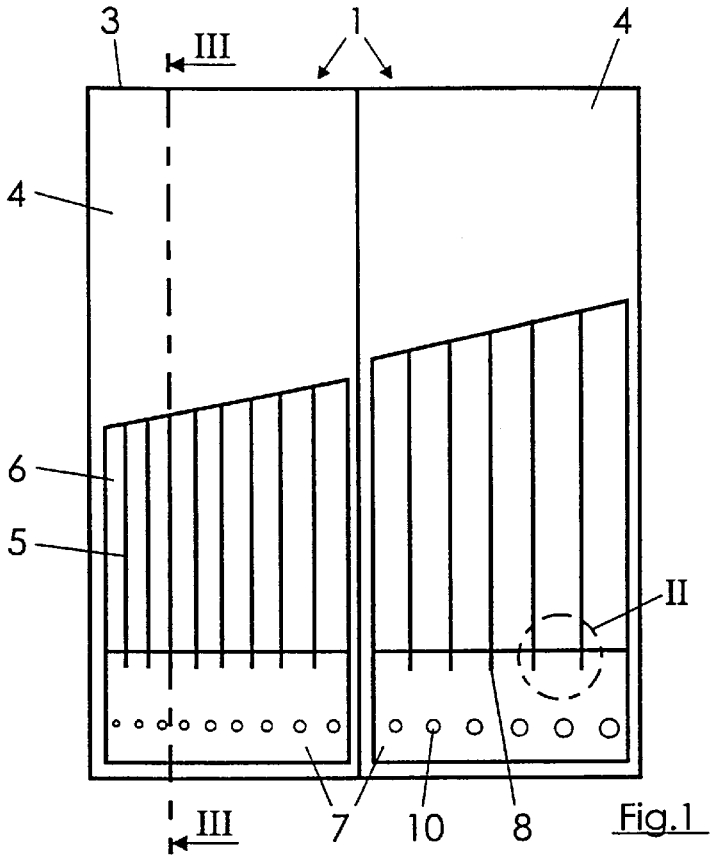
FIG. 1 shows a plan view of the open tool holder.

FIG. 1 shows a tool holder for elongate tools, in particular for drill bits, with two holder parts 1 which are connected to one another in an articulated manner on one long side and can be swung open or closed like a book. Each holder part 1 has a rear wall 2, four side walls 3 and an open front side 4. Mutually parallel crosspieces 5 which project forwards are located on the rear wall 2. Receiving shafts 6 for the tool which is to be received are formed by these crosspieces 5. As can be seen in FIG. 1, the crosspieces 5, and thus also the receiving shafts 6, are located in each of the holder parts 1. A flap 7 extends over the receiving shafts 6 and covers part of the open front side 4 and part of each of the crosspieces 5. Dimensional holes 10 of different diameters are located in the bottom region of the flap 7.

Figure 2:
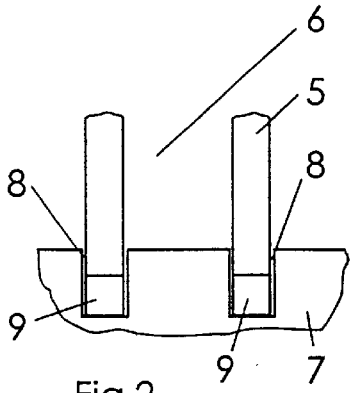
FIG. 2 shows an enlarged illustration of the clamping connection corresponding to II in FIG. 1.

FIG. 2 shows the clamping connection by means of which the crosspieces 5 and the flap 7 are connected to one another. The flap 7, on its top side, has comb-like incisions 8 which can be clamped in the protrusions 9 projecting from the crosspieces 5.

Figure 3:
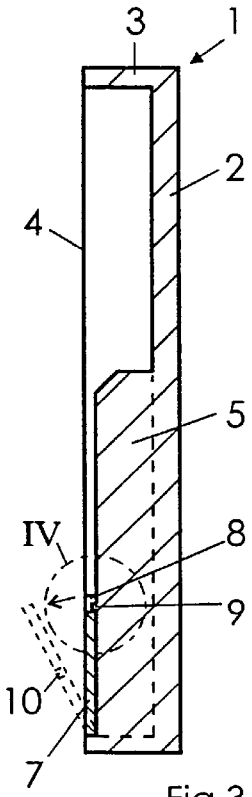
FIG. 3 shows a section along line III—III of FIG. 1.
Figure 4:
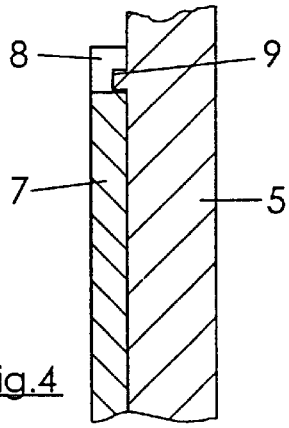
FIG. 4 shows an enlarged section of the clamping connection corresponding to IV in FIG. 3.

The clamping connection of the crosspieces 5 to the flaps 7 may likewise be seen in FIGS. 3 and 4.

Figure 5:
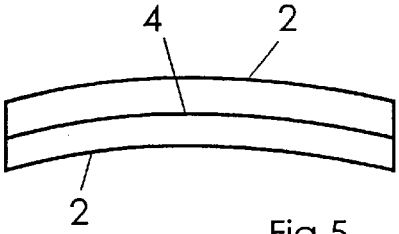
FIG. 5 shows a plan view of the tool holder from above in the closed state.

As can be seen in FIG. 4, the flap 7, in its bottom region, is connected to the holder part 1 such that it can pivot. As can be seen from FIG. 5, one of the rear walls 2 of the holder parts 1 is curved convexly and the other is curved concavely. This curvature allows the tool holder to be carried comfortably. The convex shape of one of the rear walls makes it possible for the tool holder to be carried easily in trouser pockets or in shirt pockets, since the holder is better adapted to the shape of the body as result of this curvature.

As can be seen in FIG. 1, the receiving shafts 6 in the two holder parts 1 continue one after the other with increasing widths. For this reason, it is possible for the drill bits to be located one beside the other, in a continuous series of increasing size, over the two holder parts 1. The advantage of this is that, when the holder parts are swung together, the smallest drill bits are located above the largest drill bits, as a result of which, in the closed state, the holder is better balanced in terms of weight.

I claim:

1. A tool holder for elongate tools, in particular for drill bits, with two holder parts which are connected to one another in an articulated manner on one long side and can be swung open or closed like a book, 1.1. each holder part (1) having a rear wall (2), four side walls (3) and an open front side (4), 1.2. receiving shafts (6) for the tool which is to be received being provided in each holder part (1), and being formed by mutually parallel crosspieces (5) which project forwards from the rear wall (2) of the holder part (1), 1.3. a flap (7), which extends transversely over the receiving shafts (6), in each holder part (1) covering part of the open front side (4) and part of each of the crosspieces (5), 1.4. the flap (7), in its bottom region, being fixedly or releasably arranged with the holder part (1) such that it can pivot, and 1.5. the flap (7), in its top region, being connected to the crosspieces (5) and/or the side walls (3) of the holder part (1) by a clamping or latching connection.

2. The tool holder as claimed in claim 1, wherein the flap (7) is provided with incisions (8) which latch into the crosspieces (5).

3. The tool holder as claimed in claim 2, wherein the flap (7), on its top side, has comb-like incisions (8) which can be clamped in protrusions (9) projecting from the crosspieces (5).

4. The tool holder as claimed in claim 1, wherein the flap (7) is provided with dimensional holes (10) of different diameters.

5. The tool holder as claimed in claim 4, wherein there is provided for each receiving shaft (6) a dimensional hole (10) which is adapted to the diameter of the tool which is to be positioned in said shaft.

6. The tool holder as claimed in claim 1, wherein at least one rear wall (2) of the holder parts (1) is curved convexly.

7. The tool holder as claimed in claim 1, wherein the receiving shafts (6) in the two holder parts (1) continue one after the other with increasing widths.

* * * * *